US007417376B2

(12) United States Patent
Aitken

(10) Patent No.: US 7,417,376 B2
(45) Date of Patent: Aug. 26, 2008

(54) LINEAR ELECTRON BEAM TUBE HAVING A DOME SHAPE RF WINDOW

(75) Inventor: Steven Aitken, Chelmsford (GB)

(73) Assignee: E2V Technologies (UK) Limited, Chelmsford Essex (GB)

( * ) Notice: Subject to any disclaimer, the term of this patent is extended or adjusted under 35 U.S.C. 154(b) by 160 days.

(21) Appl. No.: 11/357,417

(22) Filed: Feb. 21, 2006

(65) Prior Publication Data

US 2006/0261740 A1 Nov. 23, 2006

(30) Foreign Application Priority Data

Feb. 21, 2005 (GB) ..... 0503543.1

(51) Int. Cl.
*H01J 23/46* (2006.01)

(52) U.S. Cl. ..... 315/5.37; 315/5; 315/5.39; 333/252

(58) Field of Classification Search ..... 315/5, 315/5.37, 5.39; 333/252
See application file for complete search history.

(56) References Cited

U.S. PATENT DOCUMENTS 3,305,799 A * 2/1967 Levin ..... 333/24 R
4,611,149 A * 9/1986 Nelson ..... 315/5.39
5,854,536 A * 12/1998 Langlois et al. ..... 315/5
7,202,605 B2 * 4/2007 Heppinstall et al. ..... 315/5.16

FOREIGN PATENT DOCUMENTS

GB 2 280 541 A 2/1995

OTHER PUBLICATIONS

United Kingdom Search Report dated May 23, 2005, issued in GB0503543.1.

* cited by examiner

*Primary Examiner*—Benny Lee
(74) *Attorney, Agent, or Firm*—Venable LLP; Robert Kinberg; Kyle D. Petaja

(57) ABSTRACT

An electron beam tube device such as an inductive output tube of the integral cavity type has a RF window which re-enters the interaction space within the cavity thereby defining a space that is within the interaction cavity but is outside the vacuum. An output coupler in the form of an output coupling loop protrudes into this space and thus couples with the electromagnetic field within the interaction space, whilst remaining outside the vacuum envelope. This allows the coupling loop to be adjusted without any additional seal arrangement between the coupling loop and walls of the output cavity.

6 Claims, 3 Drawing Sheets

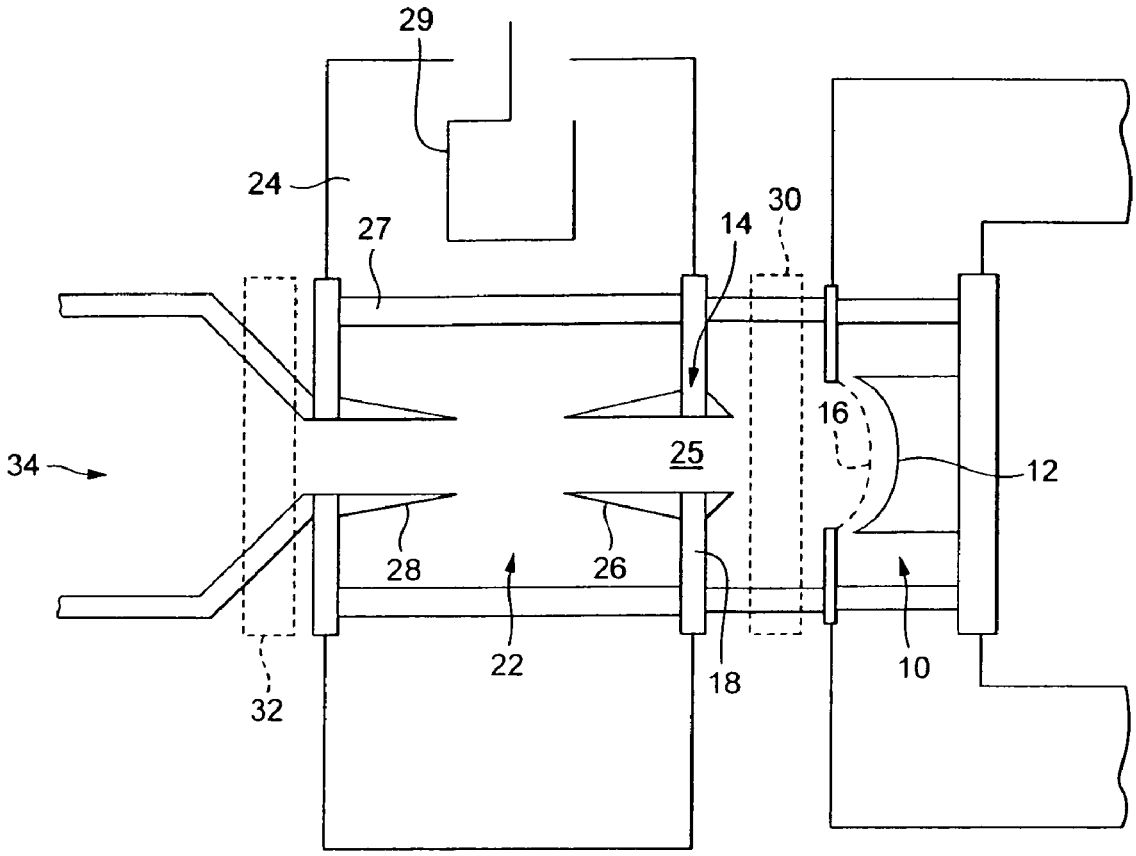
FIG. 1 - PRIOR ART
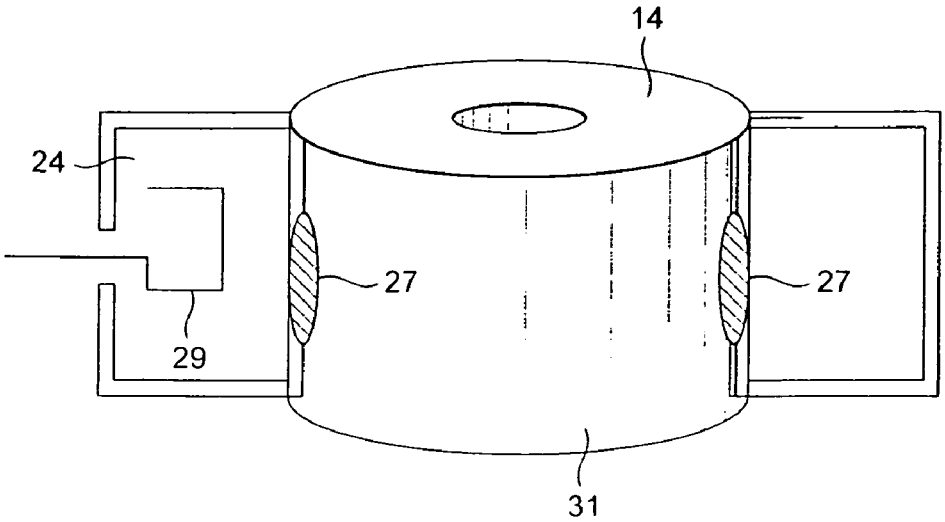
FIG. 1A - PRIOR ART

LINEAR ELECTRON BEAM TUBE HAVING A DOME SHAPE RF WINDOW

CROSS-REFERENCE TO RELATED APPLICATION

This application claims the priority of British Patent Application No. 0503543.1 filed on Feb. 21, 2005, the subject matter of which is incorporated herein by reference.

BACKGROUND OF THE INVENTION

The present invention relates to linear beam tube devices, in particular, to electron beam tube devices such as IOTs and Klystrons.

Linear beam tube devices such as electron beam tube devices are used for the amplification of RF signals. There are various types of linear electron beam tube device known to those skilled in the art, two examples of which are the klystron and the Inductive Output Tube (IOT). Linear electron beam tubes incorporate an electron gun for the generation of an electron beam of an appropriate power. The electron gun includes a cathode heated to a high temperature so that the application of an electric field between the cathode and an anode results in the emission of electrons. Typically, the anode is held at ground potential and the cathode at a large negative potential of the order of tens of kilovolts.

Electron beam tubes used as amplifiers broadly comprise three sections. An electron gun generates an electron beam, which is modulated by application of an input signal. The electron beam then passes into a second section known as the interaction region, which is surrounded by a cavity arrangement including an output cavity arrangement from which the amplified signal is extracted. The third stage is a collector, which collects the spent electron beam.

In an inductive output tube (IOT) a grid is placed close to and in front of the cathode, and the RF signal to be amplified is applied between the cathode and the grid so that the electron beam generated in the gun is density modulated. The density modulated electron beam is directed through an RF interaction region, which includes one or more resonant cavities, including an output cavity arrangement. The beam is focused by a magnetic means, typically electromagnetic coils to ensure that the electron beam passes through the RF region and delivers power at an output section within the interaction region where the amplified RF signal is extracted. After passing through the output section, the beam enters the collector where it is collected and the remaining power is dissipated. The amount of power which needs to be dissipated depends upon the efficiency of the linear beam tube. Efficiency refers to the difference between the power of the beam generated at the electron gun region and the RF power extracted in the output coupling of the RF region.

The difference between an IOT and a Klystron is that in an IOT, the RF input signal is applied between a cathode and a grid close to the front of the cathode. This causes density modulation of the electron beam. In contrast, a klystron velocity modulates an electron beam, which then enters a drift space in which electrons that have been speeded up catch up with electrons that have been slowed down to form bunches of electrons. The bunches are thus formed in the drift space, rather than in the gun region itself.

Linear beam tube devices typically have one of two output arrangements: an external output cavity or an integral output cavity. An external output cavity is one in which the output coupling, typically using a coupling loop, is external to the vacuum envelope of the drift tube interaction region. An integral output cavity is one in which the coupling loop protrudes into the interaction region.

We have appreciated the need to adjust the coupling arrangement of a linear beam tube device. We have further appreciated that this is relatively simple for external cavity devices in which the coupling loop is outside the vacuum envelope, but is problematic for prior integral cavity devices.

SUMMARY OF THE INVENTION

The invention is defined in the claims to which reference is now directed.

The invention resides in an RF window arrangement for an electron beam tube so arranged that the output coupler may extend into the interaction cavity while remaining outside the vacuum envelope of the electron beam tube. The preferred RF window arrangement is a ceramic dome which covers an output loop and provides an airtight seal to the vacuum within the tube while being substantially transparent to RF. While the preferred embodiment is a ceramic dome, other arrangements such as a closed short cylindrical arrangement may be appropriate in some applications.

BRIEF DESCRIPTION OF THE DRAWINGS

An embodiment of the invention in the various aspects noted above will now be described with reference to the figures in which:

FIG. 1: shows a schematic diagram of an electron beam tube incorporating an external cavity output arrangement;

FIG. 1A: shows a schematic perspective view of the external cavity arrangement and RF window of FIG. 1;

DETAILED DESCRIPTION OF THE INVENTION

Figure 2:
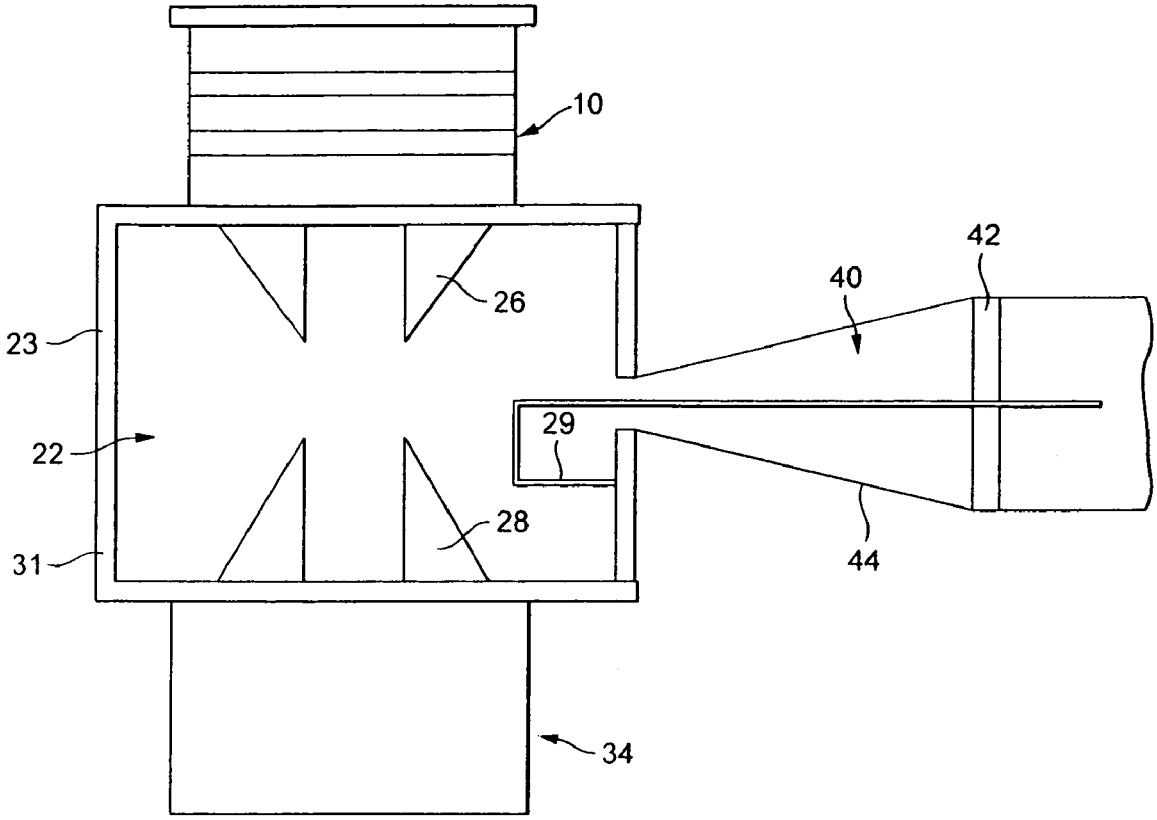
FIG. 2: shows an integral cavity arrangement of an electron beam tube.

The embodiment of the invention described is an Inductive Output Tube (IOT). However, it would be appreciated to the skilled person that the invention applies equally to other linear beam devices such as travelling wave tubes and Klystrons.

A known external output cavity IOT is first described, shown in FIG. 1, and comprises an electron gun 10 for generating an electron beam. The electron beam is created from a heated cathode 12 held at a negative beam potential of around −36 kV and accelerated towards and through an aperture in a grounded anode 14 formed as part of a first portion of a drift tube 22 described later. In normal use, the electron gun 10 is uppermost.

A grid 16 is located close to and in front of the cathode and has a DC bias voltage of around −80 volts relative to the cathode potential applied so that, with no RF drive a current of around 500 mA flows. The grid itself is clamped in place in front of the cathode (supported on a metal cylinder) and isolated from the cathode by a ceramic insulator, which also forms part of the vacuum envelope. The RF input signal is provided on an input transmission line between the cathode and grid. The electron gun 10 is connected to a drift tube or interaction region 22 and output cavity 24 by a metallic pole piece 18.

The electron beam generated by the electron gun 10, and density modulated by the RF input signal between cathode 12 and grid 16, is accelerated by the high voltage difference (of the order 30 kV) between the cathode 12 and anode 14 and accelerates into a drift tube 22. The drift tube 22 is defined as a first drift tube portion 26 and a second drift tube portion 28 surrounded by an RF cavity 24 defined in part by an outer wall 27 forming a ceramic window part of the vacuum enclosure with the electron gun and collector assembly. The electron beams passes through a central aperture 25 in the first drift tube portion 26 having a generally disc shaped portion attached to or comprising the pole piece 18 and frustoconical section. The whole drift tube, or interaction region, 22 is located within a focussing magnetic field created by an upper coil 30 and lower coil 32 shown in dashed line. This creates a magnetic field along the length of the drift tube. The magnetic field has a return path through a magnetic frame (described later). The drift tube is typically of copper. Connected to the drift tube section 22 is an output cavity 24 containing an output loop 29 via which RF energy in the drift tube section 22 couples and is taken from the IOT. This type of output cavity is an external output in the sense that the cavity 24 does not form part of the vacuum envelope defined in part by the wall 27.

The electron beam having passed through the drift space and output region 28 still has considerable energy. It is the purpose of the collector stage 34 to collect this energy.

The output cavity arrangement can be seen in the perspective view of FIG. 1A. This shows the generally cylindrical form of the main electron beam tube body 31 with grounded anode 14 and attached output cavity 24 with output loop 29 separated from the vacuum within the electron beam tube by a ceramic wall 27 which is substantially transparent to RF radiation, but seals the vacuum enclosure. This is therefore termed an "RF window". The main body of the electron beam tube is, of course, of metal.

The output arrangement shown in FIG. 1 is an external output cavity 24. An alternative cavity arrangement, for use with which the invention is particularly beneficial, is an integral output cavity shown in FIG. 2. In this arrangement, an electron gun 10 and collector 34 are arranged as before, but now the interaction region comprises the integral cavity drift tube region 22 with the first and second drift tubes 26, 28 and includes an integral output coupler 29 within a volume 40 defined by a fixed sidearm 44 attached to main body 31. The vacuum envelope is defined by the drift tube 22 and volume 40. The output coupling loop 29 extends into the drift tube cavity 22. The output cavity is thus integral with vacuum envelope. In such arrangements it is usual for the sidearm 44 to be non-removably fixed to the outer wall 23 of the drift tube cavity. The vacuum envelope is closed by a ceramic disc 42 forming an RF window.

Figure 2A:
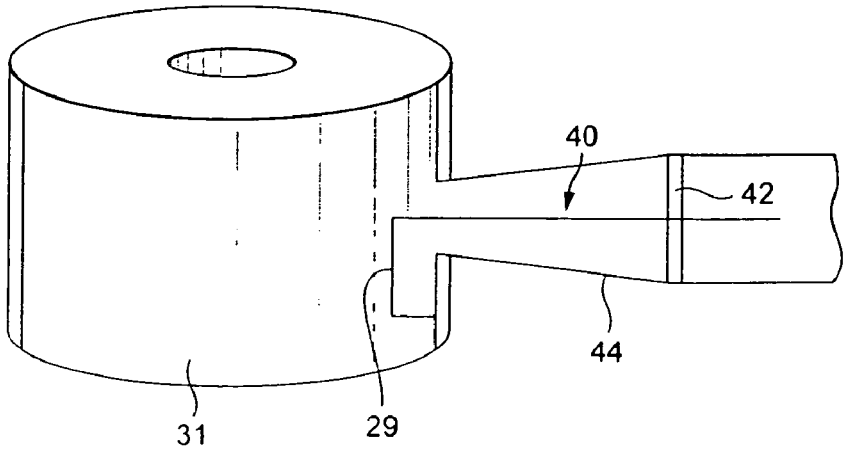
FIG. 2A: shows a schematic perspective view of the integral cavity and output feeder of FIG. 2.

The integral output cavity can be seen in perspective view in FIG. 2A. The output feeder 44 is typically permanently attached to the main body 31 of the electron beam tube and the vacuum within the tube extends into the volume 40 as far as a ceramic disc 42 forming an RF window.

Figure 3:
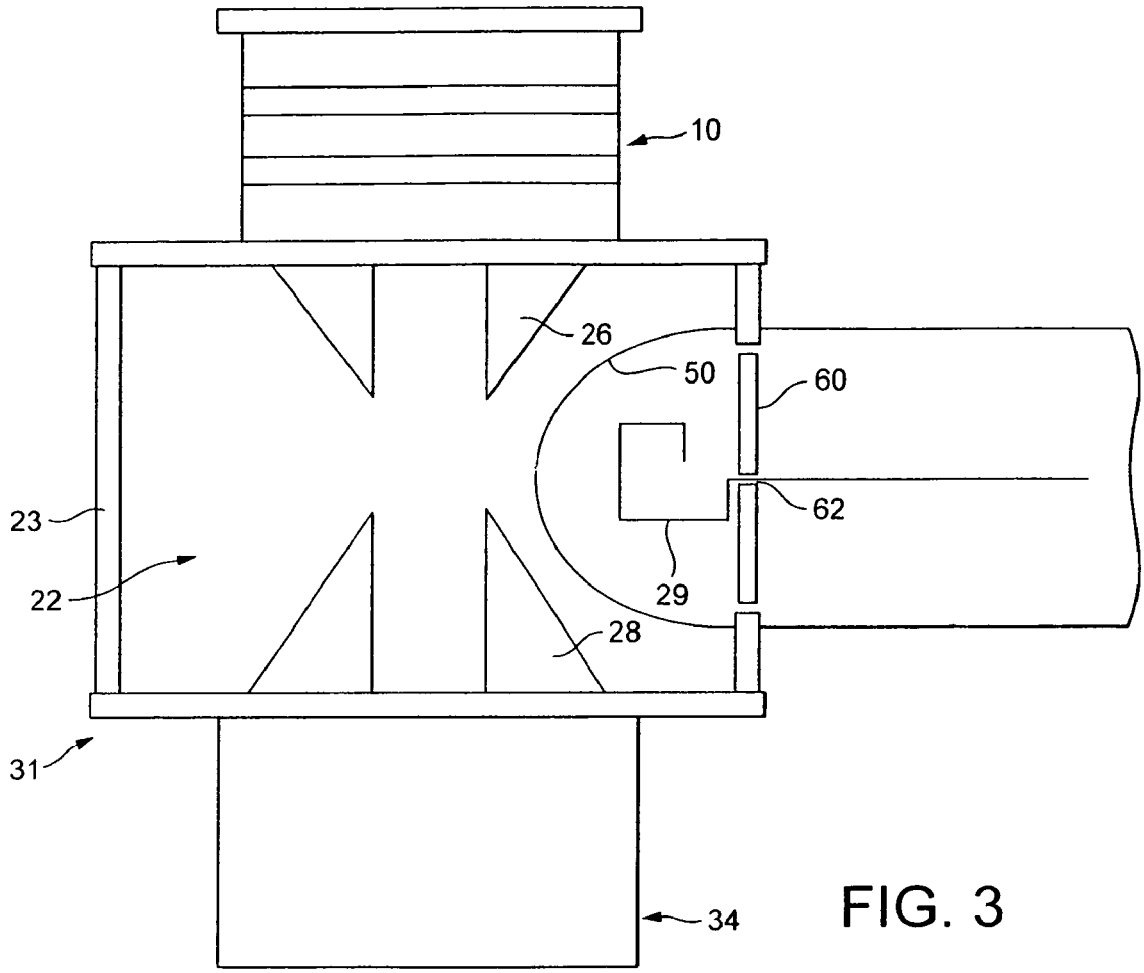
FIG. 3: shows an integral output cavity electron beam tube embodying the invention.

An integral cavity IOT embodying the invention is shown in FIG. 3. As previously noted, in a linear beam tube incorporating an integral output cavity, it is difficult in prior arrangements, to adjust the orientation of the output coupling loop once the tube has been sealed. The present embodiment of the invention overcomes this problem by utilizing an RF transparent dome or re-entrant window, protruding into the integral cavity, to enclose the coupling loop which is located outside the vacuum (in air). This allows access to the loop in order to alter its orientation within, or penetration into, the cavity.

The electron beam tube device embodying the invention as shown in FIG. 3 comprises the same basic components as described in relation to FIG. 2, and the components share the same numbering as in FIG. 2 and may not be described in detail for FIG. 3. The description of operation need not be repeated in full, but in brief, the electron gun 10 emits a beam of electrons which passes through an interaction region on drift tube 22 defined by a first drift tube portion 26 and second drift tube portion 28. The electron beam generates a magnetic field which circulates around the direction of flow of the electron beam to which the output coupler in the form of an output coupling loop 29 couples within the volume of the cavity 22. The interaction space 22 is defined by the outer metal wall 23 of the electron beam tube body 31. The magnetic field, (and consequential electric fields), generated by the electron beam circulates within this, interaction space. The spent electron beam is collected in a collector 34 in known fashion.

The coupling loop 29 penetrates into the interaction region 22, and the device is thus of the type known as an integral output cavity device. This is in the sense that the output cavity is integral with the interaction region and within the body of the electron beam tube (in contrast to the external cavity arrangement of FIG. 1). The output coupling loop 29 is not, however, within the vacuum of the beam tube as in the device of FIG. 2. Instead, the output coupling loop is outside the vacuum being separated by a ceramic dome 50 which forms an RF window and a vacuum seal. This allows the orientation and position of the loop 29 to be adjusted without any compromise of the vacuum seal. In particular, the gap 62 in the wall 60, of dielectric, needs only to allow movement of the coupling loop, and does not need to provide a vacuum seal.

Figure 3A:
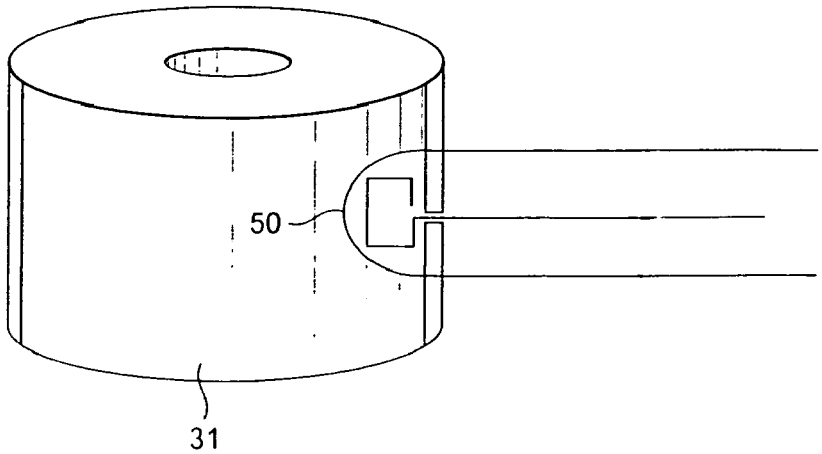
FIG. 3A: shows a schematic perspective view of the integral cavity output arrangement of FIG. 3.

The ceramic dome 50 protrudes into the cavity 22, and so is termed a re-entrant RF window, in the sense that the window re-enters the interaction cavity. The choice of a dome has a number of advantages. First, it has a large and uniform surface area so that any stray electrons striking the surface do so over a large area thereby reducing the energy per unit area that could impact the RF window. Second, the shape of the ceramic dome is strong and able to provide a vacuum seal. Third, for a given depth of penetration of the coupling loop, it provides a sensible size of RF window within the cavity. Other shapes are perfectly possible, though, provided that the coupling loop may fit and that the RF window does not impede the electron beam. The dome shaped RF window 50 protruding through electron beam body 31 can be further seen in the perspective view of FIG. 3A.

The dome is preferably of ceramic, but other materials may be appropriate having substantially RF transparency at the frequency of operation and the ability to provide a good vacuum seal. This arrangement can be used with any type of electron beam tube of the integral cavity type. In addition, an external cavity could be used as well as the integral cavity arrangement. Such further cavities can be fastened to the beam tube body 31 and sealed from the vacuum by the re-entrant window 50. The technique could also be applied to an input cavity in which a coupler must couple to a field within the input cavity. The technique may thus be considered an integral cavity and coupler arrangement.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An electron beam tube device having an integral cavity, the integral cavity having a vacuum and comprising a dome shaped RF window penetrating into the cavity to provide a vacuum seal to an output, the RF window providing a barrier to define a space that is within the cavity but is outside the vacuum, the space being arranged to receive a coupler that is thereby inside the cavity but outside the vacuum.

2. An electron beam tube device according to claim 1, wherein the RF window comprises a ceramic.

3. An inductive output tube comprising an electron beam tube device according to claim 1.

4. An electron beam tube according to claim 1, wherein the RF window is fixed to a side wall of the electron beam tube and covers an output line.

5. An electron beam tube according to claim 1, wherein the coupler comprises a coupling loop.

6. An electron beam tube according to claim 1, wherein the integral cavity is an integral output cavity and the coupler is an output coupling loop.

* * * * *